US006604655B1

(12) United States Patent
Lee

(10) Patent No.: US 6,604,655 B1
(45) Date of Patent: Aug. 12, 2003

(54) COMBINATION OF LIQUID CONTAINERS WITH CAPS DEPRESSIBLE FOR EJECTING THE CONTENTS

(75) Inventor: Yu-Kang Lee, Taipei (TW)

(73) Assignee: Jung Kuo Enterprise Co., Ltd., Taipei (TW)

( * ) Notice: Subject to any disclaimer, the term of this patent is extended or adjusted under 35 U.S.C. 154(b) by 0 days.

(21) Appl. No.: 10/083,527

(22) Filed: Feb. 27, 2002

(51) Int. Cl.[7] ..... B67D 5/56
(52) U.S. Cl. ..... 222/135; 222/183
(58) Field of Search ..... 222/135, 321.7, 222/158, 129; D9/300; D6/544

(56) References Cited

U.S. PATENT DOCUMENTS 4,969,579 A * 11/1990 Behar ..... 222/135
5,005,736 A * 4/1991 Portas ..... 222/135
5,060,823 A * 10/1991 Perlman ..... 222/158
D356,494 S * 3/1995 Eke et al. ..... D9/300
6,189,810 B1 * 2/2001 Nerushai et al. ..... 222/135

* cited by examiner

*Primary Examiner*—Philippe Derakshani
(74) *Attorney, Agent, or Firm*—Rosenberg, Klein & Lee

(57) ABSTRACT

A combination of liquid containers having caps depressible for ejecting the contents includes several holding parts, and upper part, and a bottom part. The holding parts each has a depressible cap connected to an outlet portion of the top thereof. The upper, and the bottom parts are respectively connected to the tops, and the bottoms of the holding parts, which are closely arranged together, so as to provide stability to the liquid containers.

6 Claims, 6 Drawing Sheets

COMBINATION OF LIQUID CONTAINERS WITH CAPS DEPRESSIBLE FOR EJECTING THE CONTENTS

BACKGROUND OF THE INVENTION

The present invention relates to a combination of liquid containers, more particularly one which is made of both plastic and metallic materials to be attractive, and can be stably supported on flat surface as well as provide the user with convenience in use.

Referring to FIG. 1, a conventional liquid container 10 with a cap depressible for ejecting the content is usually used for containing shampoo, detergent, bathing cream, etc. and has a depressible cap 101, an upper part 102, and a lower main holding part 103. The lower part 103 usually has a cylindrical shape, and is made of plastics.

Because there are many kinds of contents to be contained in containers of such type such as shampoo, bathing cream, detergent, and skin, toner, a user usually has to buy many containers of such type, and arrange them together in the bathroom. The user would find that it is inconvenient to use these containers because he/she has to arrange them again in order for them to be placed tidily after they are used to eject the contents. In addition, the containers can't be supported on a flat surface such as a table and a shelf relatively stably because they are separately placed on the surface, and therefore are likely to fall over when the user depresses the cap repeatedly for ejecting the contents. And, the containers are prone to fall over also because they are made of plastic materials that are light in weight.

Furthermore, the containers look cheap and are not very attractive because they are only made of plastic materials, and has only a monotonous cylindrical shape.

SUMMARY OF THE INVENTION

Therefore, it is a main object of the present invention to provide a combination of liquid containers having caps depressible for ejecting the contents that can overcome the disadvantages of the above mentioned liquid container.

The combination of liquid containers of the present invention includes several plastic holding parts, a metallic upper part, and a metallic lower part. The holding parts each has an upper outlet portion for a depressible cap to be connected thereto. The upper and the lower parts are respectively mounted around the outer sides of the tops, and the outer sides of the holding parts, which are closely arranged together, so as to provide stability to the liquid containers.

The combination of liquid containers allows the user to easily place the liquid containers in position tidily after he has used same. And, the metallic parts help the plastic containing parts look relatively valuable and attractive. In addition, the combination doesn't prone to fall over because it has more area of contact with a surface than a single container.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
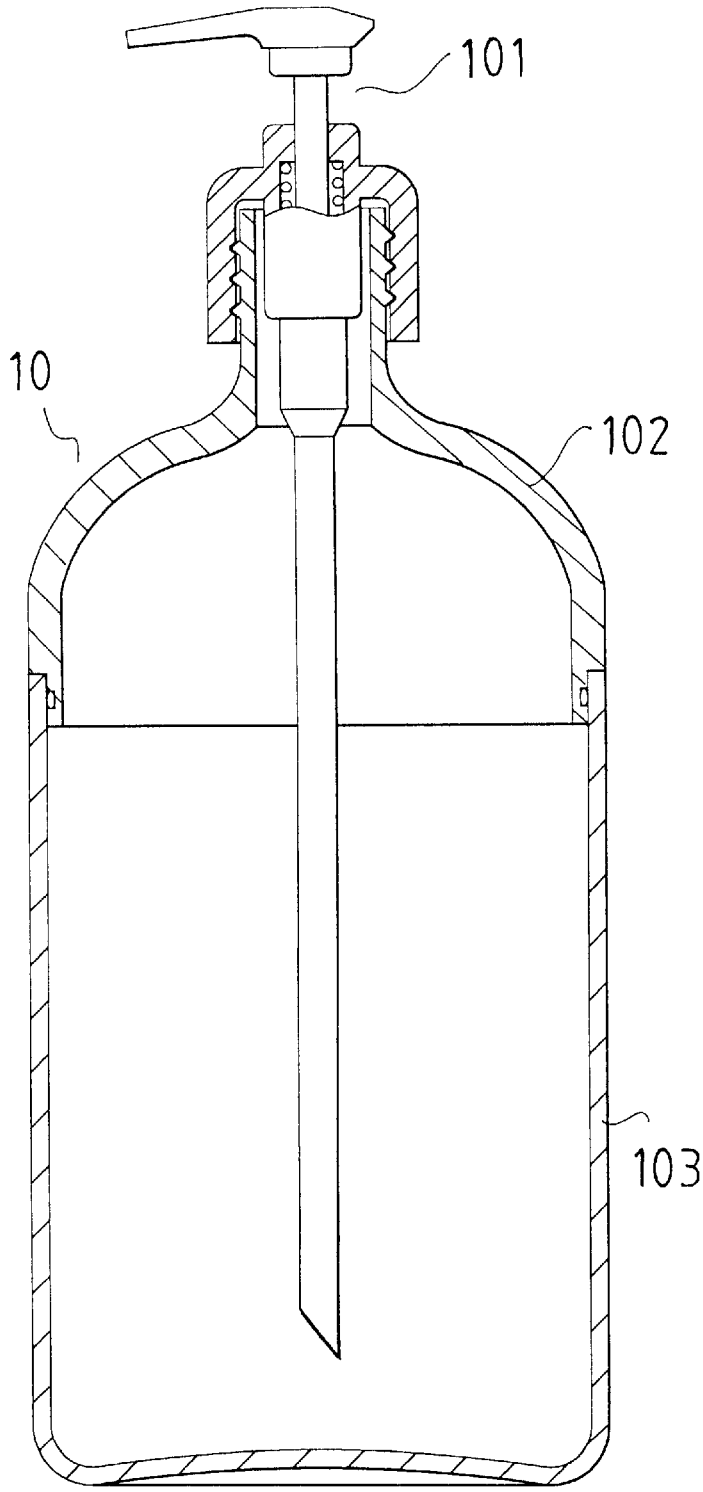
F I G. 1 (PRIOR ART)
FIG. 1 is a cross-sectional view of the conventional liquid container in the Background.
Figure 2:
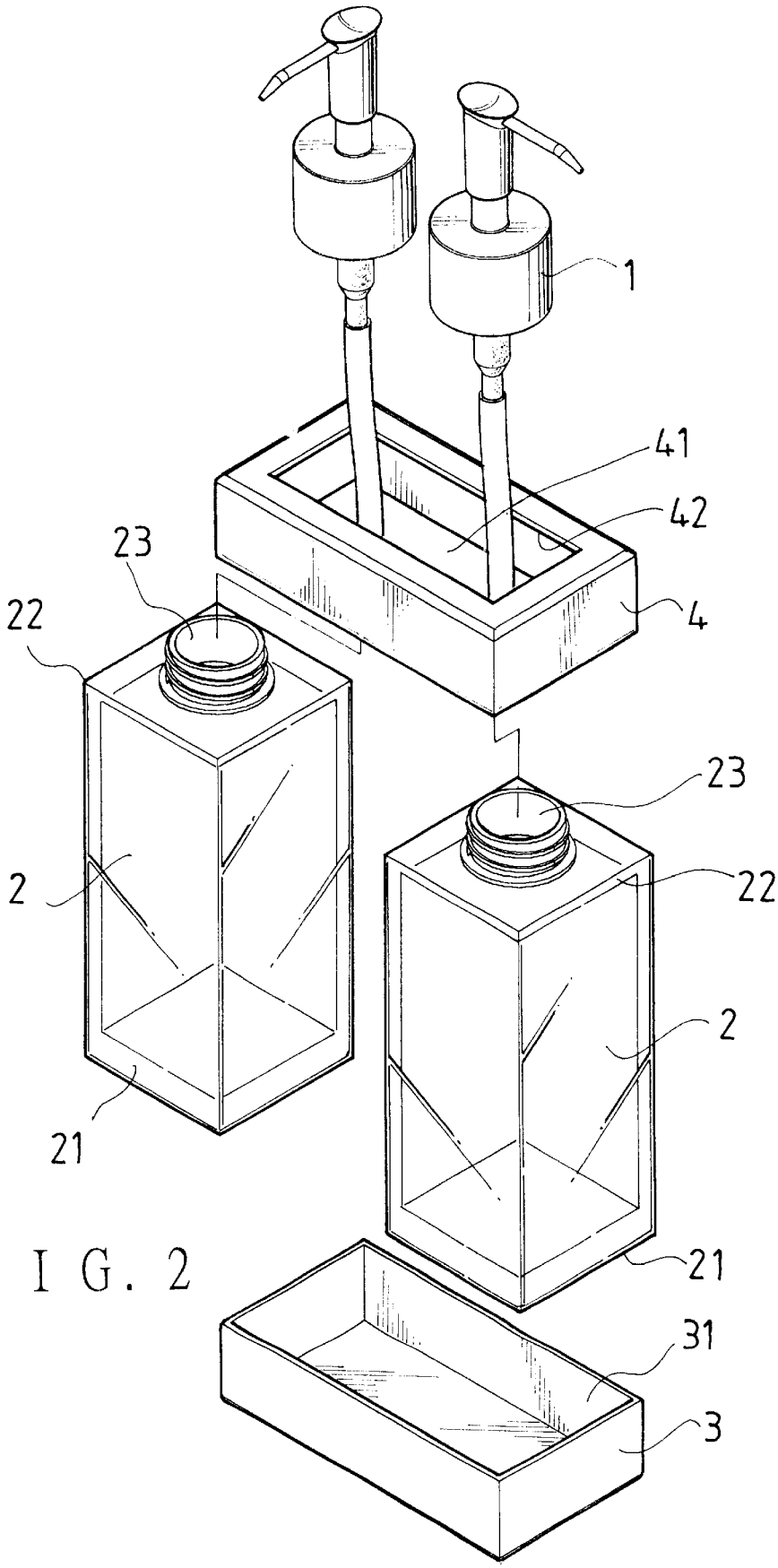
FIG. 2 is an exploded perspective view of a combination of liquid containers according to the present invention.
Figure 3:
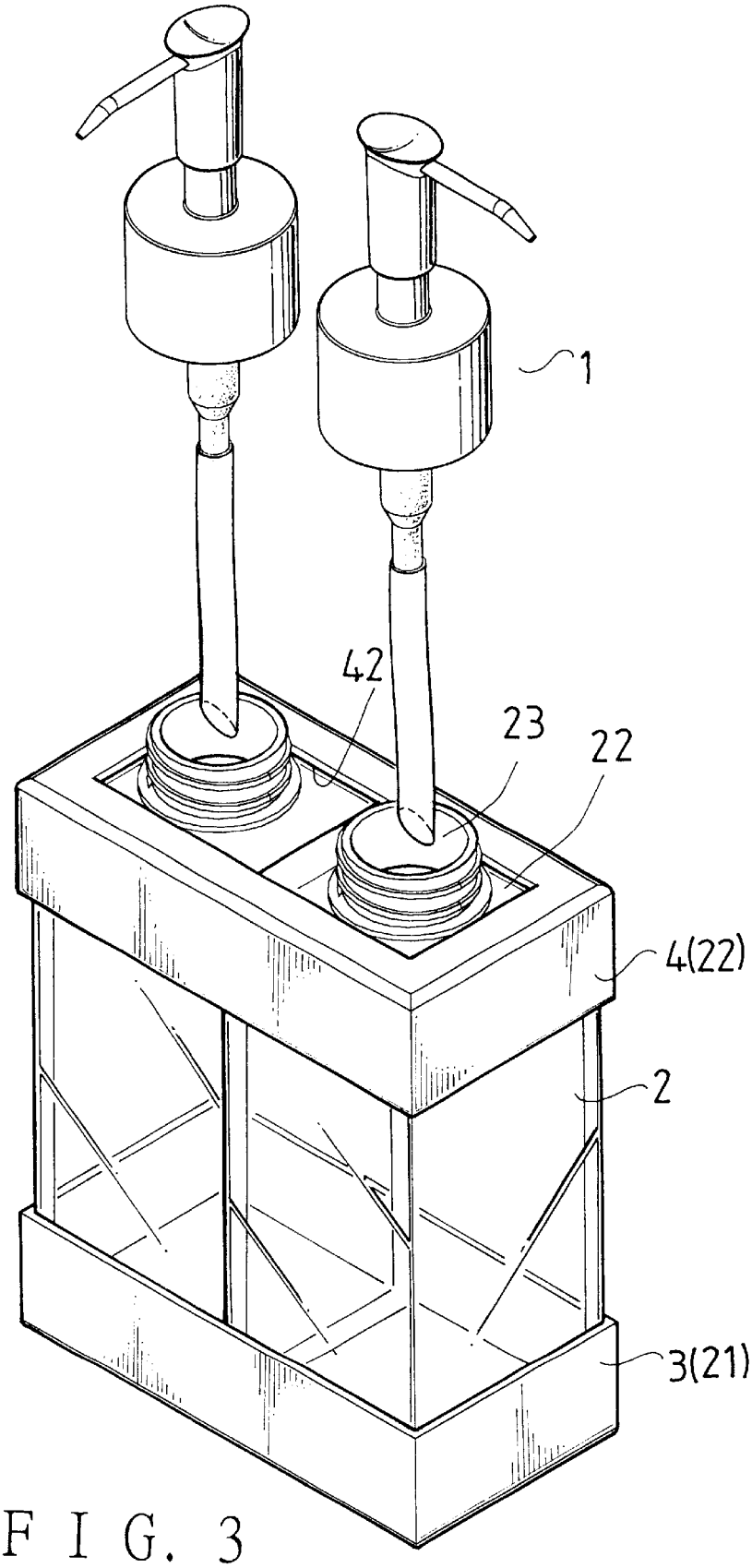
FIG. 3 is a perspective view of a combination of liquid containers according to the present invention.

Referring to FIGS. 2 and 3, a combination of liquid containers of the present invention includes at least one liquid containers consisting of both a containing part 2 and a cap 1, an upper part 4, and a bottom part.

Figure 7:
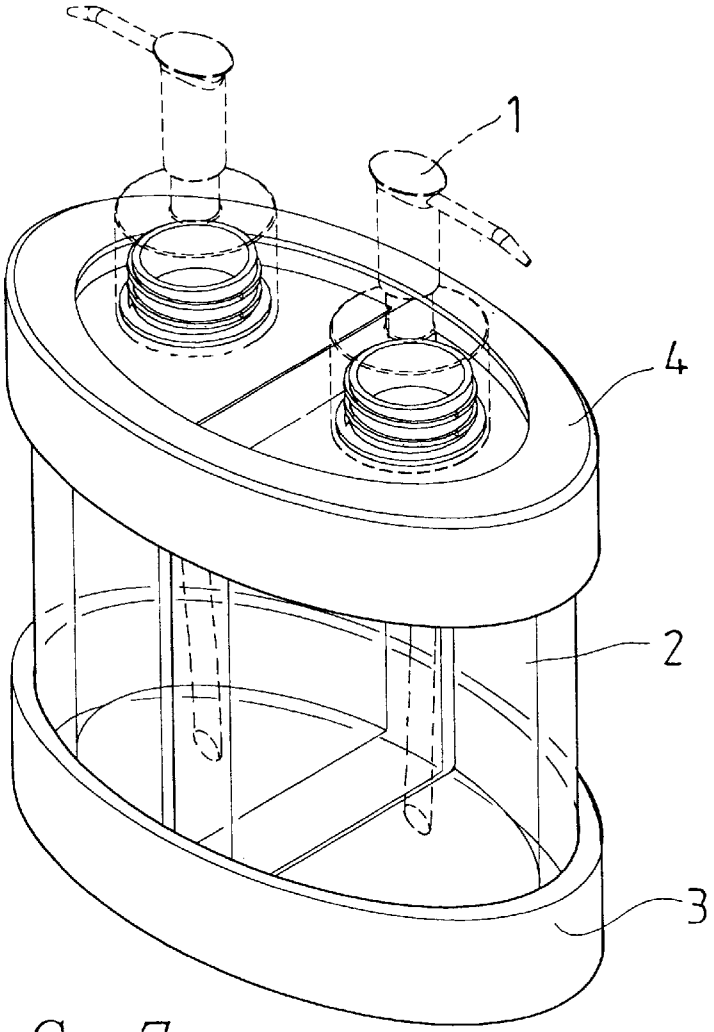
FIG. 7 is view of a fifth combination of liquid containers of the present invention.

The containing part 2 is provided for holding the liquid contents, and has a bottom 21, a top 22 and an outlet portion 23 on the top 22. The cap 1 is screwed onto the outlet portion 23 of the containing part 2 such that the contents of the containing part 2 can be ejected when it is depressed. The containing part can be made of various kinds of materials, and is preferably made of plastic and transparent or semi-transparent. The containing part can be made to have various shapes such as four straight sides (FIG. 2), and a half-oval shape (FIG. 7).

The bottom part 3 has a receiving room 31, which is defined by an enclosing wall (not numbered) made to have the contour of the bottoms 21 of the containing parts 2 arranged together; thus, the bottoms 21 of the containing parts 2 can be tightly passed into the receiving room 31.

The upper part 4 has a through hole, and a receiving room 41, which is defined by a downwards sticking enclosing wall (not numbered) that is made to have the contour of the tops 22 of the containing parts 2 arranged together; thus, the tops 22 of the containing parts 2 can be closely fitted into the receiving room 41 with the outlet portions 23 of the containing parts 2 being passed through the through hole 42 of the upper part 4.

In combination, the containing parts 2 are fitted into the bottom part 3, and the upper part 4 from the bottoms 21, and the tops 22 thereof respectively. Then, the caps 1 are connected to the outlet portions 23.

In addition, the bottom part 3, and the upper part 4 are preferably made of stainless metals such that the combination of the liquid containers can look high in quality, attractive and valuable.

Figure 4:
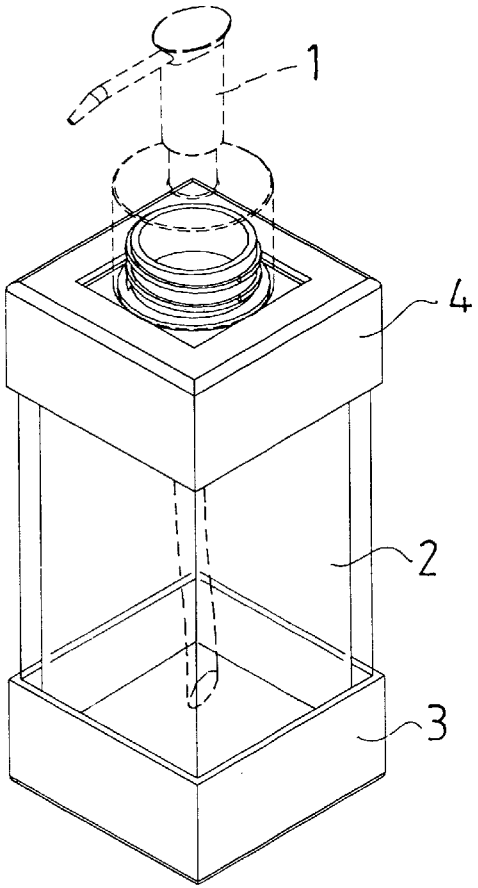
FIG. 4 is a view of another combination of liquid containers of the present invention.
Figure 5:
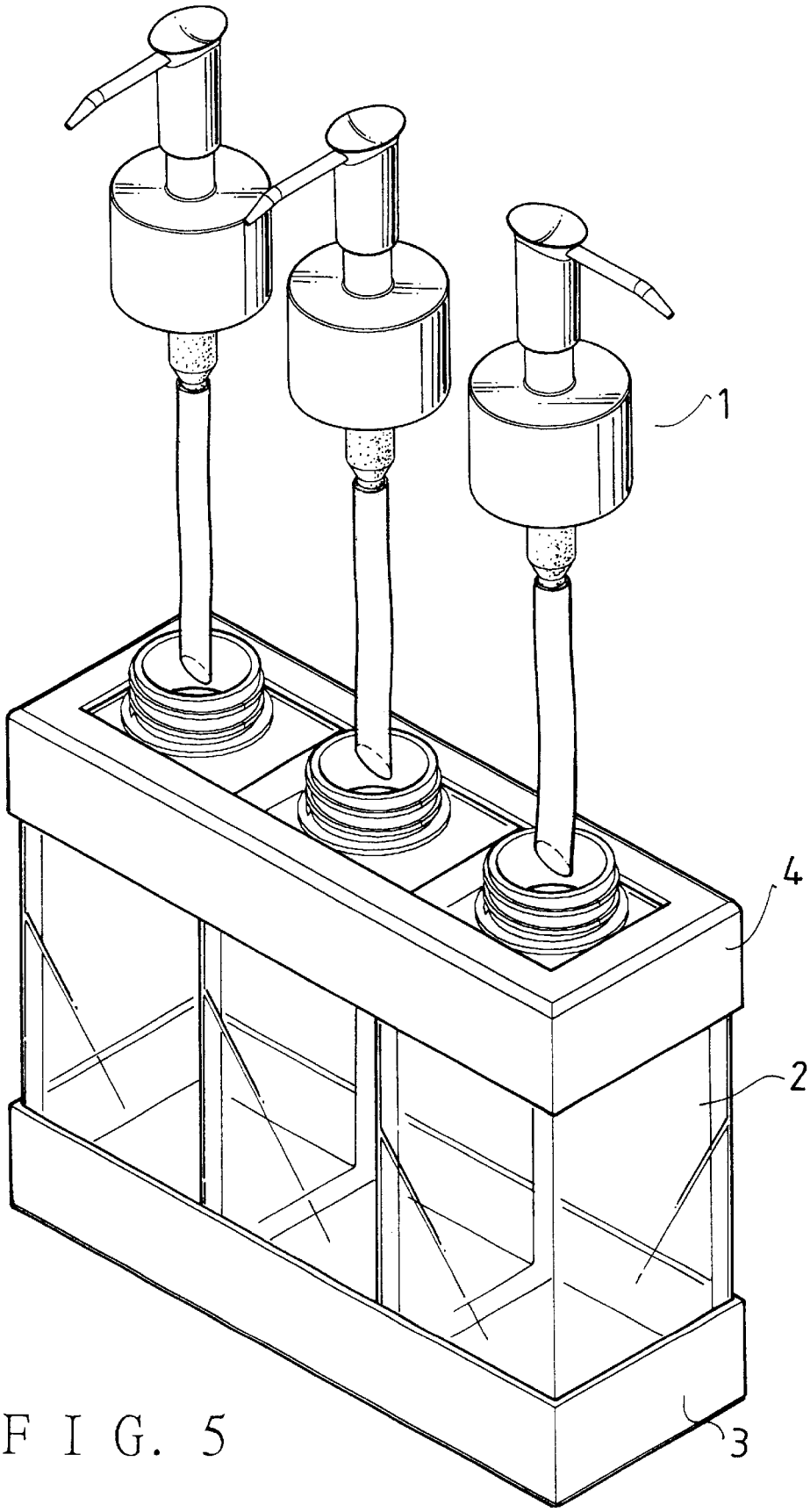
FIG. 5 is a view of a third combination of liquid containers of the present invention.
Figure 6:
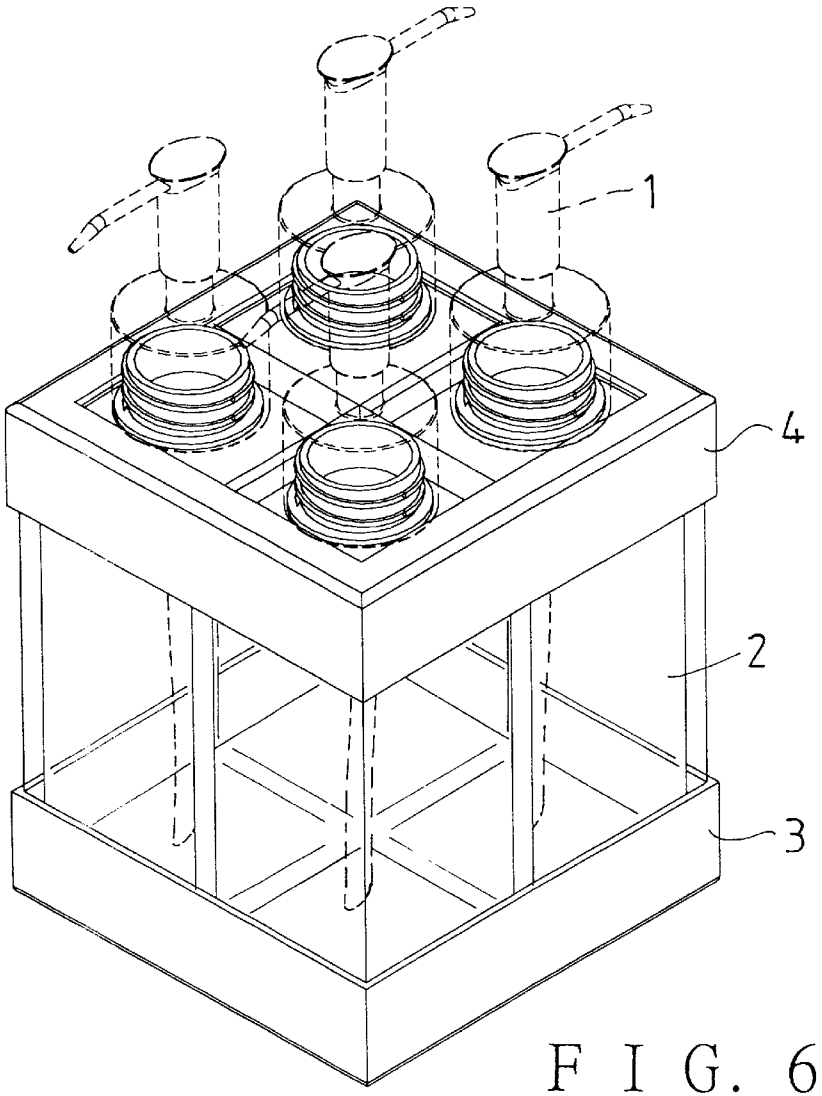
FIG. 6 is a view of a fourth combination of liquid containers of the present invention.

The number and shape of the containing parts 2 is decided according to the design. Referring to FIG. 4, there is one liquid container with four straight sides. Referring to FIG. 7, there are two liquid containers of half-oval shapes so that the combination has an oval contour. Two containing parts of half-circular contour can be connected together to become a circular combination. Referring to FIGS. 5 and 6, there are three, and four liquid containers in the combination respectively. And, the upper parts 4, and the bottom parts 3 can be made to have only one part or consist of two or more parts connected together.

From the above description, it can be easily understood that the combination of liquid containers having caps depressible for ejecting contents has advantages as the followings:

1. Because all of the liquid containers of the containers of the combination are connected together, they can be easily put back in the appropriate position after they have been used without costing the user much time or causing him inconvenience.

2. Because the containing parts can be made transparent, the user can easily see the contents thereof, allowing him to find the one he needs very easily and quickly.

3. The liquid containers are relatively stably supported on a surface as compared with the conventional ones because they are connected together to have an increased area of contact with the surface by means of both the upper and the bottom parts.

4. The combination is relatively attractive, and looks valuable as compared to the conventional liquid container because it consists of plastic parts and metallic parts.

What is claimed is:

1. A combination of liquid dispensing containers comprising:

a plurality of adjacently disposed liquid containers each including a containing part and a cap depressible for dispensing a material from the containing part, said cap being connected to an outlet portion on a top of said containing part;

a unitary upper part having a first receiving room defined by a first wall, said first receiving room having a plurality of regions each contoured to receive said top of one of said containing parts in substantially conformed manner; said first receiving room regions being in open communication one with the other, said upper part having a through hole communicating with said first receiving room for said outlet portions to be passed therethrough; and, a unitary bottom part having a second receiving room defined by a second wall, said second receiving room having a plurality of regions each contoured to receive a bottom of one of said containing parts in substantially conformed manner; said second receiving room regions being in open communication one with the other.

2. The combination of liquid containers as claimed in claim 1, wherein said upper and said bottom parts are made of stainless metallic materials, and said containing parts are made of transparent materials.

3. A combination of liquid containers as claimed in claim 1, wherein said containing parts are made of translucent materials.

4. The combination of liquid containers as claimed in claim 1, wherein there are two containing parts, each having a plurality of straight sides.

5. The combination of liquid containers as claimed in claim 1, wherein there are two containing parts, each having a half-oval contour.

6. The combination of liquid containers as claimed in claim 1, wherein there are two containing parts, each having a half-circular contour.

* * * * *